United States Patent [19]

Scheiner

[11] 4,227,762

[45] Oct. 14, 1980

[54] ELECTRICAL CONNECTOR ASSEMBLY WITH LATCHING BAR

[75] Inventor: Jack F. Scheiner, Litchfield, N.H.

[73] Assignee: Vaughn Corporation, Salisbury, Mass.

[21] Appl. No.: 61,981

[22] Filed: Jul. 30, 1979

[51] Int. Cl.[3] ..... H01R 13/62

[52] U.S. Cl. ..... 339/91 R; 339/113 L; 339/186 M

[58] Field of Search ..... 339/91 R, 113 L, 75 R, 339/75 M, 184, 186

[56] References Cited

U.S. PATENT DOCUMENTS

| | | | |
|---|---|---|---|
| 2,546,854 | 3/1951 | Foster | 339/113 L |
| 3,137,535 | 6/1964 | Collier et al. | 339/91 R |
| 3,395,377 | 7/1968 | Straus | 339/113 L |
| 3,829,821 | 8/1974 | Derr et al. | 339/91 R |
| 3,901,575 | 8/1975 | Hoover | 339/91 R |
| 3,945,706 | 3/1976 | Steiner et al. | 339/113 L |
| 3,963,296 | 6/1976 | Glover et al. | 339/75 M |

*Primary Examiner*—John McQuade

*Attorney, Agent, or Firm*—Schiller & Pandiscio

[57] ABSTRACT

An improved electrical connector assembly (for transmitting biopotential signals) comprises a main terminal connector associated with a master cable connectable to the signal processing apparatus and at least one plug associated with a single cable connectable to an biopotential electrode for sensing the biopotential signal of increase. The connector comprises a cavity defining a plurality of contiguous passageways each structured so as to receive the plug in only one direction to provide proper polarization. The design of the plug and the passageways, a color coding provided on the housing and the plug, the provision of an automatic interlocking mechanism allowing each plug to be inserted in any passageway and automatically locked in place, provides for easy, reliable and quick connections to be made. The preferred connector is designed to be easily cleaned such as by immersing it in a cleaning fluid, and the connecting pins are provided in a protective manner in the connector.

16 Claims, 5 Drawing Figures

ELECTRICAL CONNECTOR ASSEMBLY WITH LATCHING BAR

The present invention relates generally to electrical connector assemblies and more particularly to an improved electrical connector assembly for simultaneously and independently transmitting a plurality of signals with little or no distortion or interference.

With the increased activity in the physiological sciences to understand more about living bodies and to improve health care, there has been an increase in the use of apparatus for acquiring biopotential signals for diagnostic as well as monitoring purposes. For example, such signal acquisition apparatus have been developed and used for monitoring and recording cardiopotentials from the chest and limbs, electromyographic signals from the abdominal surface of pregnant women, electrooculographic signals indicating eye motions by applications from appropriate positions on the scalp, transthoracic impedance differentials indicating apneic spells in neonatal patients, etc. In more recent years, these biopotential measuring apparatus have been employed for long term testing, such as Holter testing, requiring continual monitoring times from about 24 hours to about 72 hours so that any arythmias which occur during this period can be recorded on a specially adapted recorder. Similarly, patients in intensive care units must be monitored continuously so that they can receive treatment as quickly as possible if they should require it.

In all these diagnostic and monitoring techniques it is necessary to place one or more biopotential electrodes in electrical contact with the skin of the subject (typically by using an electolytic gel) at prescribed locations depending upon the particular biopotential signals to be acquired. Suitable cabling is typically utilized to connect each electrode to apparatus for processing (such as recording or displaying) the signals acquired. In some monitoring and testing situations many electrodes are placed at various locations requiring many cables to be attached at particular locations on the processing apparatus so that the various acquired signals may be properly processed. This can be terribly time consuming for both the person setting up the testing and monitoring equipment as well as for the subject.

Accordingly, it is an object of the present invention to provide an improved electrical connector assembly and cabling system which enables the various cables connected to various biopotential electrodes to be easily, quickly and reliably connected to the testing and monitoring equipment.

Another object is to provide an improved electrical connector assembly and cabling system which enables various cables to be connected to testing and monitoring equipment and allows the simultaneous and independent signal transmission of the various acquired signals with little or no distortion or interference so as to substantially preserve the signal content of these signals.

And other objects of the present invention are to provide an improved electrical connector assembly for coupling individual cables to a master cable, the assembly having (1) an improved hermetically sealed compact housing so as to preserve the electrical transmission properties of the connector, (2) an interlocking mechanism which allows each cable to be easily connected to the master cable, automatically locked in place and easily disconnected when testing and monitoring is completed, (3) utilizes an approved color coding system which makes it easy to identify the various cables as they correspond to the individual signals they are to transmit, and (4) has an asymmetrical structure so that each cable can only be connected in one orientation so as to always provide proper polarization.

These and other objects of the present invention are provided by an improved electrical connector assembly comprising a main terminal connector associated with a master cable and at least one plug associated with a single cable. The main terminal connector comprises a housing having a receiving end which defines an elongated opening. The opening exposes a cavity having a first plurality of grooves, each of a first predetermined cross-sectional shape on one side of the opening, and a second like plurality of grooves, each of a second and different cross-sectional shape on the other side of the opening. The first and second plurality of grooves oppose one another so as to form a like plurality of contiguous passageways. The main terminal connector further comprises a plurality of terminal pins supported with respect to the housing, each of the pins being electrically connectable to the master cable. The pins are associated in pairs with two pins being disposed in a spaced-apart relationship in a corresponding one of the passageways. A slot is formed in the housing on one side of the cavity transverse to the first plurality of grooves. An elongate locking bar is also provided. The bar has formed along its length thereof, a plurality of spaced-apart notches, each being associated with a respective one of the grooves of the first plurality. The bar is mounted within the slot for movement between (a) a locking position wherein the notches are spaced from the grooves of the first plurality and the bar partially obstructs each of the passageways, and (b) an unlocking position wherein each of the notches is substantially aligned with a corresponding one of the grooves of the first plurality so that each of the passageways is substantially unobstructed. Biasing means biases the locking bar in the locking position.

The plug includes an insertion end having a cross-section so as to be slidably receivable in a snug-fitting manner in any one of the passageways to a fully inserted position. The plug comprises a pair of terminal openings in the insertion end. Means are disposed in each opening and electrically-connected to the single cable, for receiving and making electrical contact with the corresponding terminal pins disposed in any one of the passageways when the plug is in the inserted position. The insertion end includes (a) means cooperative with the locking bar, for moving the bar from the locking position to the unlocking position against the biasing means when the plug is slid in the passageway to the inserted position, and (b) locking means cooperating with the locking bar when the plug is in the inserted position and the locking bar is in the locking position, for locking the plug in the particular passageway into which it is inserted.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

For a fuller unerstanding of the nature and objects of the present invention, reference should be had to the following detailed description taken in connection with the accompanying drawings wherein.

In the drawings, the same numerals refer to like parts.

Figure 1:
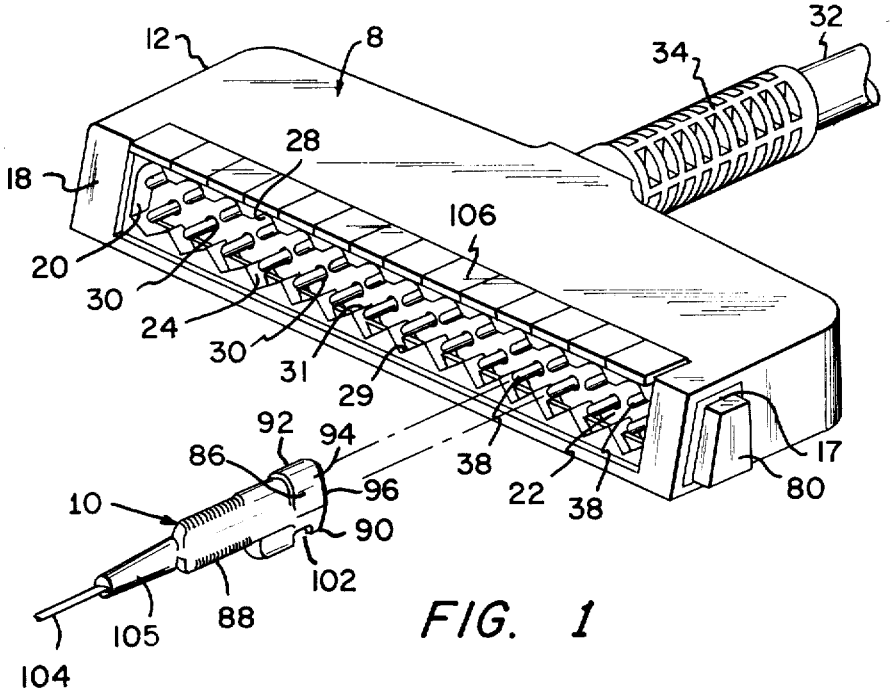
FIG. 1 is a perspective view of a preferred embodiment of the present invention.
Figure 2:
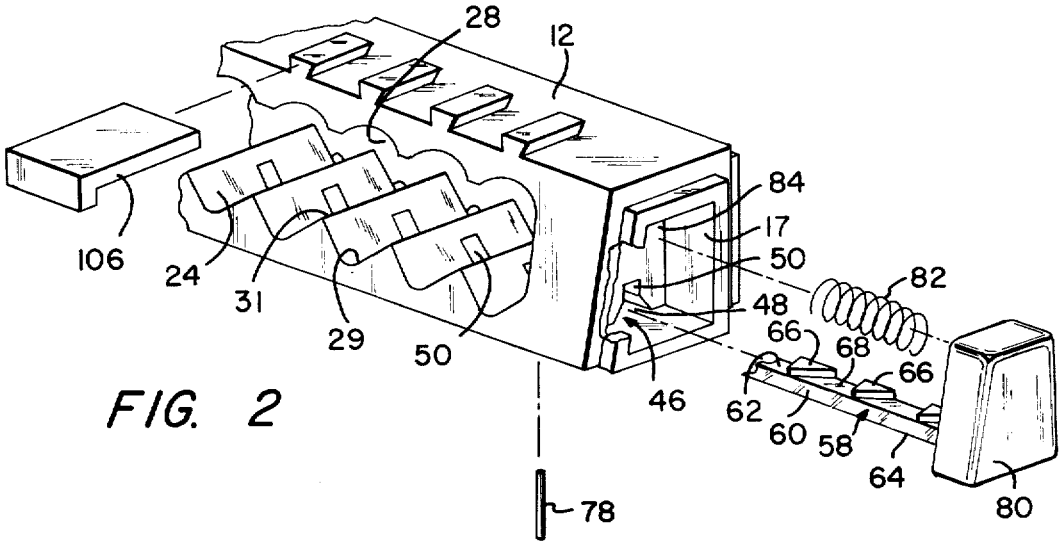
FIG. 2 is an exploded perspective view of a portion of the main terminal connector of the FIG. 1 embodiment.
Figure 3:
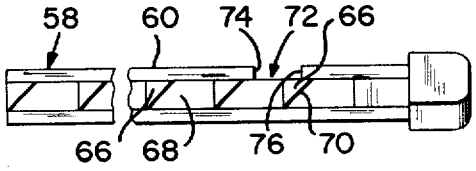
FIG. 3 is a top view partially cut away, of the slide bar used in the embodiment of FIG. 1.
Figure 4:
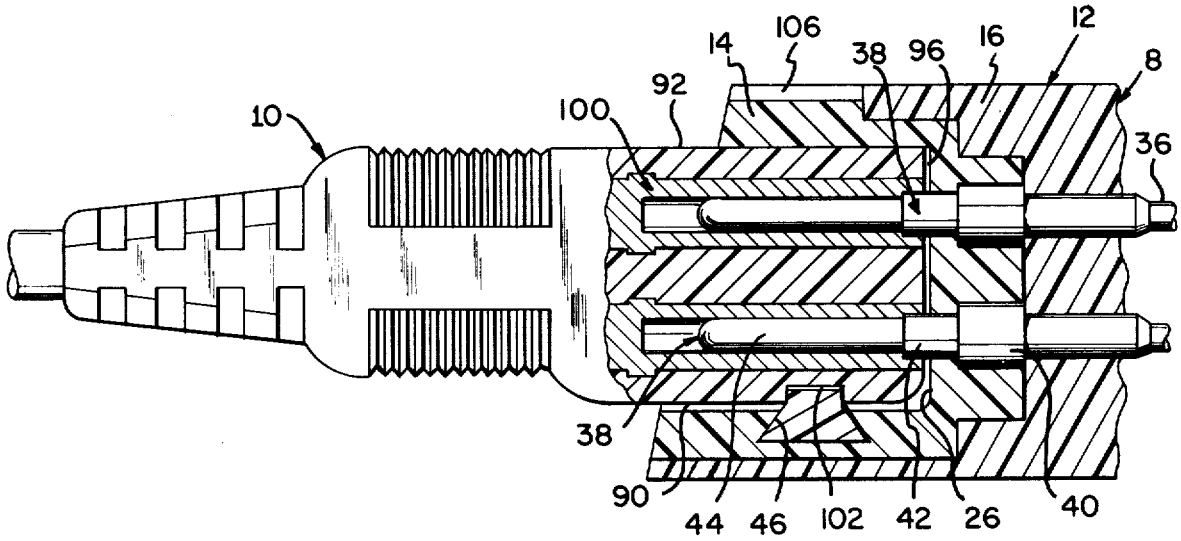
FIG. 4 is a side view partially shown in section, of the embodiment of FIG. 1 illustrating a plug locked in the inserted position in a passageway of the main terminal connector.

In FIGS. 1-4, the embodiment shown comprises the main terminal connector 8 and at least one plug 10. The connector 8 comprises a junction box or housing 12. Although housing 12 can be made as a single integral piece, preferably it is formed to include inner and outer sections 14 and 16 (shown best in FIG. 4) with intersection 14 being disposed in a nested relationship with section 16. The housing 12 is made so that an opening 17 is provided in the side of housing 12 and the sections 14 and 16 form a receiving end 18. The receiving end defines an elongated opening 20 in the front of the section 14 so as to define a cavity 22 for receiving a plurality of plugs 10. Inner section 14 has a first plurality of grooves 24 on one side of the cavity 22 extending from the opening 20 to the rear wall 26 of the cavity. Inner section 14 of housing 12 is also provided with a second like plurality of grooves 28 on the other side of the cavity opposite grooves 24 extending from the opening 20 to the rear wall 26 of the cavity so as to form with the grooves 24 a like plurality of contiguous passageways 30, each for receiving an individual plug 10. Preferably, the cross-sectional shape and dimensions of each of the grooves 24 is the same as the other grooves 24 and the cross-sectional shape and dimensions of each of the grooves 28 are all the same but different from that of grooves 24 so that when plug 10 is inserted in any one of the passageways 30 it will fit in each passageway but in only one proper orientation so as to provide proper polarization, as will be evident hereinafter. As shown in the embodiment of FIG. 1, grooves 24 are substantially vee-type grooves having a V-shaped cross section with bottoms 29 and raised edges 31 therebetween, while grooves 28 are of substantially semi-circular cross-section.

Housing 12 is preferably supported at one end of master cable 32 with a webbed flexible relief section 34 so as to provide a more durable mounting of the cable to the housing to help insure longer life. Cable 32 preferably is of a coaxial type including a plurality of inner individually shielded transmission lines (shown at 36 in FIG. 4), two corresponding to each passageway 30, in order to reduce signal noise created by motion of the cable. The other end of the cable 32 is suitably connected to the signal processing apparatus (not shown).

Connector 8 also comprises a plurality of terminal pins 38 supported by the rear wall 26 of section 14 of housing 12. Each pin 38 is electrically connected to a separate one of the transmission lines 36 in any suitable manner well known in the art so that the connections between the pins and the corresponding lines introduce little or no distortion to signals transmitted therethrough. The pins 38 are associated in pairs, the two pins of each pair being disposed in a spaced-apart relationship in a corresponding one of the passageways 30. Preferably, the pins are mounted so that one pin of each pair is positioned nearer the groove 24 of the passageway, while the other pin is positioned nearer the groove 28. The pins are preferably each formed as a single preformed element having a sealing collor 40 of a first cross-sectional diameter at the end of the pin connected to the particular transmission line 36, an intermediate section 42 of a smaller cross-sectional diameter, and an elongated terminal post 44 of a yet smaller cross-sectional diameter, extending in the elongated direction parallel to passageway 30 and adapted to engage and slide in the appropriate terminal opening of plug 10 as will be more evident hereinafter. Each pin is preferably mounted in rear wall 26 of inner section 14 of housing 12 so that the individual lines 36 are hermetically sealed from the individual passageways 30. In particular, inner section 14 can be formed as a single integral piece (such as by injection molding) so that the collar 40 and intermediate section 42 are supported in the rear wall 26 in a hermetically sealed manner. In addition, by making each pin 38 with an electrically-conductive yet chemically inert material, such as coating the pin with gold or the like, and subsequently molding outer section 16 of housing 12 over the section 14 encasing transmissin lines 36 and forming relief section 34 on the end of master cable 32, the lines 36 can be hermetically-sealed from cavity 22, and the entire housing 12 including cavity 22 can be immersed in a suitable cleaning fluid without subjecting the connector 8 to harmful corrosive action.

Connector 8 is provided with a slot 46 formed in inner section 14 of housing 12, and in particular the side of cavity 22 provided with grooves 24. The slot is oriented transversely, and preferably perpendicular to the direction of grooves 24. Preferably, one portion of the slot is dovetailed in cross-section as shown at 48 in FIG. 2 which portion does not extend above the bottom 29 of the grooves 24. A second portion 50 of the slot is substantially rectangular in cross-section and extends above the bottom 29 of each groove 24 but preferably below the rasied edges 31.

The connector 8 further comprises an elongated locking bar 58. Bar 58 includes an elongated base section 60 having a narrower top 62 and a wider base 64, and a plurality of camming elements 66 (one for each groove 24) which extend above the top 62 of the base section 60. The elements 66 are spaced in the elongated direction along the top 62 of the base section 60 so as to form notches 68 therebetween. The camming elements 66 are each formed to provide a camming surface 70 extending transversely at an acute angle to the elongate direction of the base section 60. Bar 58 also includes a guide groove or channel 72 which is providedin the side of the base section 60 and defines the two stopping surfaces 74 and 76 at each of the channel. The cross-sections of base section 60 and elements 66 are such that the bar 58 is freely slidable in slot 46 (with base section 60 sliding in the dovetail cross-sectioned portion 48 and the elements 66 sliding through the portions 50 of the slot) between (a) a locking position wherein the notches 68 are out of alignment with the grooves 24, and a camming element extends into each of the grooves 24 so as to partially obstruct each passageway 30 and so that the camming surface 70 of each camming element faces the opening 20, and (b) an unlocking position wherein the notches 68 are in alignment with the corresponding grooves 24 so that each of the passageways 30 is substantially unobstructed.

A pin 78 is provided in the housing 12 and is positioned so as to extend into the guide channel 72 of the locking bar 58. Pin 78 is secured in the housing 12 so that when the bar 58 is moved in slot 46 the pin will contact surface 74 of the channel 72 when the bar is in the locking position and will contact surface 76 of the channel when the bar is in the unlocking position. In this manner the pin 78 limits the movement of the bar between the two positions. The bar is provided at one end with button 80 which is slidable in the side opening 17 of housing 12 when the bar is moved between the locking and unlocking position.

Means preferably in the form of spring 82 is provided for biasing the locking bar in the locking position. More particularly the spring can be compressed between button 80 and a suitable walled section 84 provided in opening 17 of the housing forcing the bar and in particular the surface 84 of guide channel 72 into contact with pin 78.

The plug 10 includes an insertion end 86 and a gripping section 88. The insertion end 86 has a cross-sectional shape such as to be slidably receivable in a snug-fitting manner in any one of the passageways 30. In particular, the insertion end 86 of the plug 10 of the preferred form includes a substantially V-shaped edge 90 along its bottom edge substantially matable with and slidable in each of the grooves 24 and a cylindrical edge 92 opposite the edge 90 and matable with and slidable in the corresponding groove 28 of the passageway 30 in which the plug is inserted. The sides 94 of the plug between the edges 90 and 92 are formed so that two plugs can be inserted in adjacent passageways 30 with sufficient clearance between them so that one can be withdrawn and reinserted without effecting the other. The insertion end 86 further includes a front end 96 having a pair of spaced apart terminal openings. Each opening is provided with electrically-conductive means in the form of electrically-conductive sheath or receptacle 100 sized so as to receive in a nested, snug-fitting relationship the appropriate terminal post 44 of the corresponding pin when the plug 10 is inserted in the particular passageway 30. Each receptacle 100 is made of a highly electrically conductive material and is preferably made of the same material as each pin 38 so as to provide good contact with little or no distortion. The insertion end 86 further includes a slot 102 provided in the edge 90 spaced from the front end 96.

The gripping section 88 may be suitably provided with a preformed surface to make it easy to grip when inserting and withdrawing each plug from a passageway 30.

The plug 10 is supported at the end of the single cable 104 with a webbed flexible relief section 105 provided at the end of section 88 opposite the insertion end 86, so as to provide a more durable mounting of the cable to the plug to help insure longer life. Cable 104 comprises two conductors (not shown) suitably connected to the respective receptacles 100 of plug 10. The cable is preferably of the coaxial type properly shielded in order to help reduce signal noise created by motion of the cable. The opposite end of each cable is provided with a suitable connector (not shown) adapted to be electrically connected to an electrode for detecting biopotential signals.

The plug 10 may be inserted into any one of the passageways 30 by pushing the button 80 against the biasing spring 82 so as to move the locking bar 58 from the locking position to the unlocking position so that the notches 68 of the bar are aligned with the grooves 24 and each passageway is unobstructed. The insertion end 86 of the plug is properly oriented with the V-shaped edge 90 aligned with groove 24 and the cylindrical edge 92 aligned with the corresponding groove 28. The insertion end 86 is then slid in the passageway whereupon the two terminal posts 44 of the pins 38 associated with that passageway will engage and slide in the corresponding receptacles 100 of the plug making good electrical contact therebetween. The plug is slid until the front end 96 is adjacent to or contacts the rear wall 26 of cavity 22. The button 80 can then be released resulting in the bar 58 moving from the unlocking position to the locking position, whereupon the particular camming element 66 will move into the corresponding groove 24 of the passageway and slot 102 of plug 10. In this position, the plug cannot be withdrawn from the passageway due to the presence of the camming element 66 in the slot 102.

Alternatively, if desired each plug can be inserted without depressing the button 80. In this situation, the plug properly oriented and the insertion end 86 inserted in the particular passageway. The plug is pushed to the rear wall 26 of the cavity 22. As the plug is moved the bar will remain in the locking position until a portion of front end 96 of the plug 10 contacts the camming surface 70 of the particular camming element 66 disposed in the groove 24. By maintaining sufficient pressure while inserting the plug, the bias of spring 82 can be overcome, moving by camming action the bar from the locking position to the unlocking position to enable the plug to be fully inserted until the front end 96 is adjacent or contacts the rear wall 26 of the cavity 22, whereupon the bar will move under the bias of spring 82 from the unlocking position to the locking position and the camming element 66 into the slot 102.

It should be appreciated that due to the snug-fitting friction fit of each plug in the passageway, the plugs will not easily withdraw when inserting other plugs, whether button 80 is pushed or not.

When it is desirable to withdraw a plug, the button 80 is pushed so as to move the bar from the locking position to the unlocking position and so as to move the camming elements out of the slots 102 and the grooves 24 making each passageway 30 unobstructed so that each plug can be withdrawn.

In order to aid the user to insure each plug is inserted in the correct passageway a color coding system can be employed such as that recommended and approved by the American Heart Association. Accordingly, the top of housing 12 is suitably provided with detachable colored tabs 106, each of a unique color or combination of colors and positioned above a respective one of the passageways 30. Each tab may be indicative for example, of a particular location of the body. The plugs used with housing 12 may be similarly color coded so that it can be easily identified as to what location of the body the opposite end of cable 104 is connected to and in which passageway the plug should be inserted.

Figure 5:
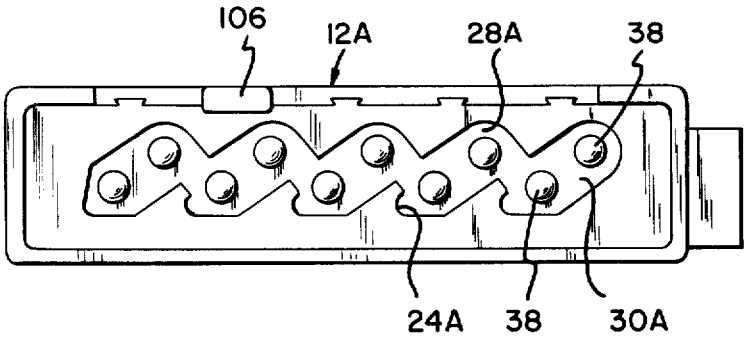
FIG. 5 shows a view of the receiving end of a main terminal connector illustrating a modification to the FIG. 1 embodiment.

Although the invention has been described in one preferred form, various modifications can be made to the assembly without departing from the scope of the invention. For example, although the passageways 30 are oriented substantially vertically (i.e. the direction between the particular grooves 24 and 28 associated with each passageway is oriented so as to be perpendicular to the elongate direction of opening 20) as shown in FIG. 1 to provide an economy of space, where fewer cables are necessary such as intensive care monitoring, the passageways may be slanted as shown at 30A with regard to one another as shown in FIG. 5 so as to reduce the height of the housing 12A. Specifically, the direction between the particular grooves 24 and 28 associated with each passageway is oriented so as to be at an acute angle to the elongate direction of opening 20. Although the shapes of the grooves 24 and 28 are modified as shown at 24A and 28A, respectively, they are shaped so as to accommodate the shape of the insertion end 86 of plug 10.

The electrical connection assembly of the present invention has several advantages. The design of plugs 10 and the passageways 30, the color coding provided by the plugs 10 and tabs 106; the ability of the locking bar 58 to move with the insertion of each plug all provide a cabling system which enables the various cables 104 connected to various biopotential electrodes to be easily, quickly and reliably connected to the signal processing apparatus. The structure allows each plug to be inserted with proper polarization, with the receptacles 100 properly aligning with the corresponding pins 38 so as to make reliable connections with little or no distortion. With each pin 38 disposed within the cavity 22, it is substantially protected from abusive treatment. Further, by hermetically sealing the pins in the rear wall 26 of cavity 22, the electrical transmission properties of the connector can be preserved. The movable locking bar 58 and the structure of plug 10 provides an improved interlocking mechanism which allows each plug 10 to be easily inserted, and locked in place in a passageway 30 when testing or monitoring and easily disconnected when testing or monitoring is completed.

Since certain changes may be made in the above apparatus without departing from the scope of the invention herein involved, it is intended that all matter contained in the above description or shown in the accompanying drawing shall be interpreted in an illustrative and not in a limiting sense.

I claim:

1. An electrical connector assembly comprising, in combination:

a main terminal connector associated with a master cable comprising (1) a housing having a receiving end, said receiving end defining an elongated opening exposing a cavity having a first plurality of grooves each of a first predetermined cross-sectional shape on one side of said cavity and a second like plurality of grooves each of a second cross-sectional shape, on the other side of said cavity, said first and second plurality of grooves opposing one another so as to form a like plurality of contiguous passageways from said opening to the back of said cavity;

(2) a plurality of terminal pins supported with respect to said housing, each of said pins being electrically connectable to said master cable, said pins being associated in pairs, the two pins of each pair being disposed in a spaced-apart relationship in a corresponding one of said passageways;

(3) a slot formed in said housing on said one side of said cavity transverse to said first plurality of grooves;

(4) an elongated locking bar having formed along its length thereof a plurality of spaced-apart notches, each notch being associated with a corresponding one of said grooves of said first plurality, said bar being mounted within said slot for movement between (a) a locking position wherein said notches are spaced from the grooves of said first plurality and said bar partially obstructs each of said passageways, and (b) an unlocking position wherein each of said notches is substantially aligned with a corresponding one of said grooves of said first plurality so that each of said passageways is substantially unobstructed; and (5) biasing means for biasing said locking bar in said locking position; and at least one plug associated with a single cable including an insertion end having a cross-section so as to be slidably receivable in a snug-fitting manner in any one of said passageways to a fully inserted position, said plug comprising a pair of terminal openings in said insertion end, and means disposed in each opening and electrically-connectable to said single cable, for receiving and making electrical contact with the corresponding terminal pins disposed in said one passageway when said plug is in said inserted position, said insertion end including (a) means cooperative with said bar for moving said bar from said locking position to said unlocking position against said biasing means when said plug is slid in said passageway to said inserted position, and (b) locking means cooperating with said locking bar when said plug is in said inserted position and said locking bar is in said locking position, for locking said plug in said passageway.

2. An assembly according to claim 1, wherein said first and second cross-sectional shapes are different.

3. An assembly according to claim 1, wherein said first predetermined cross-sectional shape is substantially V-shaped and said second predetermined cross-sectional shape is semi-circular.

4. An assembly according to claim 1, wherein said slot includes a first part disposed below said grooves of said first plurality and a second part extending above the bottom of said grooves of said first plurality.

5. An assembly according to claim 4, wherein said bar includes a base portion slidable in said first portion of said slot and a plurality of elements defining therebetween said notches, said elements being slidable in said second part of said slot.

6. An assembly according to claim 5, wherein each of said elements of said bar includes a camming surface, wherein said means for moving said bar cooperates with said camming surface so as to move said bar against the bias of said biasing means.

7. An assembly according to claim 6, wherein said means for moving said bar includes at least a portion of the front end of said plug.

8. An assembly according to claim 6, wherein said locking means includes a slot formed in said plug and the portion of the particular element of said bar disposed in the corresponding groove of the first plurality is disposed in said slot of said plug when said plug is in said inserted position.

9. An assembly according to claim 6, wherein said first part of said slot is formed as a dovetail slot and said second part of said slot is formed in rectangular cross-section.

10. An assembly according to claim 1, wherein said pins are mounted to the rear wall of said cavity in a hermetically-sealed manner.

11. An assembly according to claim 1, wherein said housing includes an inner portion and an outer portion, said inner portion defining said cavity and being mounted in said outer portion in a nesting relation.

12. An assembly according to claim 11, wherein said pins are mounted in said inner portion of said housing in the rear wall of said cavity in a hermetically-sealed manner.

13. An assembly according to claim 1, further including a like plurality of said plugs, wherein said housing and said plugs are color coded such that each passageway and a corresponding one of said plugs is designated with a unique color code so as to indicate the nature of the signal to be transmitted therethrough.

14. An assembly according to claim 1, wherein the direction of each of said passageways between the particular grooves of said first and second plurality associated with each passageway is oriented so as to be perpendicular to the elongate direction of said opening.

15. An assembly according to claim 1, wherein the direction of each of said passageways between the particular groove of said first and second plurality associated with each passageway is oriented so as to be at an acute angle to the elongate direction of said opening.

16. An assembly according to claim 1, wherein said bar includes a channel and said connector further includes a pin extending into said channel wherein said locking and unlocking positions are defined by the respective opposite ends of said channel contacting said pin.

* * * * *